US009695387B2

(12) United States Patent
Astolfi et al.

(10) Patent No.: US 9,695,387 B2
(45) Date of Patent: Jul. 4, 2017

(54) TRANSPARENT EXTRUDED TOILET SOAP

(71) Applicant: Conopco, Inc., Englewood Cliffs, NJ (US)

(72) Inventors: Rafael Astolfi, São Paulo (BR); Jorge Luiz Basso, Valinhos (BR); Sergio Roberto Leopoldino, São Paulo (BR)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/308,377

(22) PCT Filed: Apr. 30, 2015

(86) PCT No.: PCT/EP2015/059454

§ 371 (c)(1),
(2) Date: Nov. 2, 2016

(87) PCT Pub. No.: WO2015/169678

PCT Pub. Date: Nov. 12, 2015

(65) Prior Publication Data

US 2017/0051235 A1 Feb. 23, 2017

(30) Foreign Application Priority Data

May 8, 2014 (EP) ..... 14167506
Aug. 5, 2014 (EP) ..... 14179846

(51) Int. Cl.

| | |
|---|---|
| ***C11D 17/00*** | (2006.01) |
| ***C11D 9/00*** | (2006.01) |
| ***C11D 7/26*** | (2006.01) |
| ***C11D 3/22*** | (2006.01) |
| ***C11D 13/18*** | (2006.01) |
| ***C11D 3/20*** | (2006.01) |

(52) U.S. Cl.

CPC ..... *C11D 17/0095* (2013.01); *C11D 3/2065* (2013.01); *C11D 3/221* (2013.01); *C11D 7/265* (2013.01); *C11D 9/007* (2013.01); *C11D 13/18* (2013.01)

(58) Field of Classification Search

None

See application file for complete search history.

(56) References Cited

U.S. PATENT DOCUMENTS

| | | | | |
|---|---|---|---|---|
| 3,926,828 | A * | 12/1975 | O'Neill | C11D 9/005 510/108 |
| 5,529,714 | A * | 6/1996 | Tokosh | C11D 9/007 510/147 |
| 5,993,371 | A * | 11/1999 | White | C11D 1/83 510/147 |
| 6,060,808 | A | 5/2000 | Cassady et al. | |
| 6,706,675 | B1 | 3/2004 | Demson et al. | |
| 2003/0027734 | A1 * | 2/2003 | Chokappa | C11D 1/04 510/147 |
| 2004/0043913 | A1 | 3/2004 | Demson et al. | |

FOREIGN PATENT DOCUMENTS

| | | |
|---|---|---|
| EP | 2154234 | 2/2010 |
| WO | WO9958636 | 11/1999 |
| WO | WO03010273 | 2/2003 |
| WO | WO2012136502 | 10/2012 |

OTHER PUBLICATIONS

Search Report and Written Opinion in EP14179846, Mar. 16, 2015.
Search Report and Written Opinion in PCTEP2015059454, Jul. 6, 2015.

* cited by examiner

*Primary Examiner* — Necholus Ogden, Jr.
(74) *Attorney, Agent, or Firm* — Ronald A. Koatz

(57) ABSTRACT

The present invention relates to extruded soap bars having improved transparency. Specifically, by balancing the amounts of $C_{16}$ (palmitic acid) and $C_{18}$ (stearic acid) fatty acids to have a ratio in the final bar of 1, substantially improved transparency is unexpectedly obtained.

15 Claims, No Drawings

TRANSPARENT EXTRUDED TOILET SOAP

FIELD OF THE INVENTION

The present invention relates to substantially transparent soap bars made from a fatty acid blends, derived from vegetal sources, wherein fatty acid blends comprising $C_{16}$ (palmitic acid) to $C_{18}$ (stearic acid) are used. The bars are suitable for the mass market. The soap bars include a fatty acid blend, polyols and co-adjuvants. Typically, $C_{16}$ (palmitic acid) to $C_{18}$ (stearic acid) fatty acids in these blends should be used such that the ratio of $C_{16}$ to $C_{18}$ in final bar, based on blends selected, is substantially 1:1. The amount of either $C_{18}$ (stearic acid), $C_{16}$ (palmitic acid) or both fatty acids in the original fatty acid blend is adjusted to provide such ratio in final bar; bars with this ratio have a transparency, measured in terms of transmittance of light, of at least 15%, more preferably at least 16% (e.g., from 15% to 60%). Bars of the invention are capable of being manufactured at high production rates by processes that generally involve the extrusion forming of ingots or billets, and stamping or molding of these billets into individual tablets, cakes, or bars. By the term "capable of high manufacturing rates" is meant that the soap bar mass is capable of being extruded at a rate in excess of 9 kg per minute up to 45 kg per minute. Preferably, the mass is extruded a rate at or exceeding 27 kg per minute, preferably at or exceeding 36 kg per minute and as high as 45 kg/min. Personal washing bars produced from compositions according to the invention, in addition to being capable of being processed at high production rates, also possess a range of desirable physical properties that make them highly suitable for everyday use by mass market consumers.

BACKGROUND OF THE INVENTION

Soap bars for cleansing are typically prepared by saponifying or neutralizing triglyceride and free fatty acids. In this saponification process, various fats (e.g., tallow, palms and coconut oil blends) are saponified in the presence of alkali (typically NaOH) to yield alkaline salts of fatty acid (derived from the fatty acid chains forming the glyceride) and glycerol. Glycerol is then typically extracted with brine to yield dilute fatty acid soap solution containing soap and aqueous phase (e.g., 70% soap and 30% aqueous phase, especially water). The soap solution is then typically dried (e.g., to about 12% water) and the remaining mass is milled, plodded and stamped into bars. Alternatively, the soap solution can be cast into moulds, blisters etc.

Soap transparency levels vary depending on the composition and production method. Cast melt soap bars are soap bars which are typically made by casting the melted composition into moulds and letting the composition cool. Extruded soap bars are usually made by producing an extruded billet of soap and cutting it into small pieces, having a bar shape; the bars are further stamped, giving the bar its desired shape. For mass market, extrusion is more economical and yields higher amounts of processed bars per minute.

Typically, compositions that yield transparent soap bars are made using cast melt processing due to the flexibility in the process and compositions which can be used. Cast melting allows very high levels of soluble material, e.g., polyols, soluble soaps, and even non-soap detergents, to be used. Conversely, extruded soap bars compositions usually provide opaque bars. It is desirable to have extruded soaps which have higher transparency.

Generally however, particularly because of the composition required to produce a transparent soap bar (i.e., having a transparency index of at least 15%, preferably at least 16%), the production of a transparent soap bar by extrusion (e.g., forming a billet and stamping the bar) is considered extremely difficult.

When extruded translucent soap bar formulations are made of a high load of palm soap (e.g., soap produced by saponification of palm oil), typically the soap bar is opaque due to the proportion of the types of fatty acids introduced from the palm blend.

U.S. Pat. No. 6,706,675 discloses a translucent soap bar composition that includes a soap mixture, a polyalkylene glycol, at least one of glycerin and sorbitol, water and optionally, free fatty acid. The soap bar composition exhibits translucent properties; the reference defines a translucent soap as one that allows light to pass through it but, as the light may be scattered by a small proportion of crystals or insolubles, it is not possible to clearly identify objects behind the translucent soap (column 1, lines 30-34). This is not the case in the present invention in which transparent bars are produced. Furthermore, the soap bar composition includes a soap mixture, a polyalkylene glycol, at least glycerin and/or sorbitol, water and optionally free fatty acid, having 0.5 to about 5.0% of a polyethylene glycol with a molecular weight in the range of about 300 to about 800 (column 2, lines 2-4), and the soap is a blend with sodium tallowate, palm oil and palm kernel oil (column 2, lines 37-39). Such oils provide soaps with amounts of palmitic to $C_{18}$ (Stearic acid) acids such that ratios range from 2.17 to 18.92; according to The Lipid Handbook, Gunstone et. al., Second Edition, herein incorporated as reference. Applicants have found that these are not desired ratios for achieving transparency in fatty acid based soap bars in which fatty acid blend comes primarily from vegetable based oils. For this reason, it is believed, the reference discloses use of a polyalkylene glycol having a relatively low molecular weight to enhance the translucent properties of the soap bar composition (Column 3, lines 25-31). In particular, PEG 8 (column 5, lines 10 to 14) is used to improve translucency. By contrast, the subject invention utilizes a balance between palmitic and $C_{18}$ (stearic acid) acids to ensure that a ratio of substantially 1 in final bar is obtained (since little or no $C_{16}$ and $C_{18}$ in bar is introduced except through fatty acid blends, the ratio obtained from balancing the blend practically defines the ratio in the final bar). The reference also uses fatty acid blends derived from animal source, such as tallow, which are well known in the art for the production of transparent bars, while the subject invention uses fatty acid blends derived primarily from vegetal based oils which were then balanced via addition of $C_{18}$ (stearic acid) or $C_{16}$ (palmitic acid) acids to provide a ratio of $C_{18}$ to $C_{16}$ of 1:1. In short, fatty acids derived primarily from tallow (animal based oil known for production of transparent bars) and PEG 8 appear to be required in the reference to create greater translucency; this is not the case of the present invention (see Comparative 2 for lack of results from the incorporation of PEG 8 into Comparative 1 of the present invention).

WO 9958636 (Cognis Corp.) discloses a translucent personal cleansing bar with (a) an alkyl polyglycoside corresponding to formula I: R1O(Z)a wherein R1 is a monovalent organic radical having from 8 to 10 carbon atoms, and a is a number having a value of from 1.40 to 1.55; (b) a soap component derived from a fatty acid having an iodine value from 25 to about 44; and (c) water.

WO03010273 (Unilever PLC) discloses a transparent soap bar comprising: (i) from 30 to 60% by weight of the soap bar of total fatty matter wherein from >1 to 15% by weight is the salt of 12-hydroxyCi8 (Stearic acid) acid or a precursor thereof; (ii) from 20 to 50% by weight of the soap bar of at least one polyhydric alcohol; and (iii) water.

WO12136502 (Hindustan Unilever Limited) discloses a transparent soap bar with improved transparency via addition of a fluorescer at selective levels.

Thus, previous attempts to enhance transparency in soap bars are provided by inclusion of tallow in complex compositions for extruded bars using fatty acid blends derived primarily from animal source of oils or by producing via cast melt process. Transparent bars made from fatty acid blends derived predominantly from vegetal oils (e.g., oils derived from vegetable sources) are not believed known.

Nowhere is there disclosed compositions providing transparency to the soap bar while processing the bar via extrusion using simple, but unexpected, balanced ratios of fatty acids as provided by applicants' claimed invention.

The present invention is the result of experimentation investigating the use of different fatty acids (i.e. $C_{16}$ (palmitic acid) and $C_{18}$ (stearic acid)) in balanced amounts as an alternative to animal oil based soaps to improve transparency properties while processing the bar via extrusion. Surprisingly, soap bars with good transparency produced by extrusion can be obtained.

The compositions of the present invention have shown to yield extruded soap bars with substantially improved transparency.

SUMMARY OF THE INVENTION

Brief Description of the Invention

Quite unexpectedly, applicants have found that using soaps (having fatty acid blends derived predominantly from vegetal sources) with specific blends of fatty acids, wherein similar amounts of $C_{16}$ (palmitic acid) to $C_{18}$ (stearic acid) are used, i.e. ratios of $C_{16}$ to $C_{18}$ soaps are in defined ranges and wherein at least a minimum amount of $C_{16}$ and $C_{18}$ is required (e.g., $C_{16}$ and $C_{18}$ comprise 25% of fatty acid blend), it is possible to make soap bars via extrusion and which have enhanced transparency when compared to bars made using fatty acid blends derived primarily from animal oil based soap blends.

Specifically, the invention comprises substantially transparent extruded soap bar compositions having from 55% to 80% by weight of soap, wherein said soap comprises a fatty acid blend derived predominantly from vegetal based oils (e.g., fewer than 3% of total fatty acids in final composition are derived from animal based oils), wherein said fatty acid blend comprises from 25% to 45% of $C_{16}$ (palmitic acid) and $C_{18}$ (stearic acid) fatty acids; and wherein said bar compositions further comprise 3% to 25% by wt. polyols. It should be noted that, even when relatively high amounts of polyols (i.e 10-12%) are used in the final product, the bars will not show significant level of translucency (Table 1, comparative examples 1 and 2 at columns 1 and 2) if ratios of $C_{16}$ to $C_{18}$ are not adjusted. On the other hand, formulations with the ratio $C_{16}$:$C_{18}$ adjusted as close as possible to 1:1 will present significant degree of translucency, even at about the same level of polyol used (see Examples 1-3 versus examples in Table 1). Further compositions comprise 0.1 to 50% of co-adjuvants such as electrolytes and perfume; and the remainder of water. Preferably, bars comprise 0.5 to 10%, preferably 3% to 10% by weight of sucrose. Preferably, the bars comprise 0.2 to 10% of 12-hydroxy oleic acid. The ratio of $C_{16}$ fatty acid (palmitic acid) to $C_{18}$ fatty acid (stearic acid) in the final bar (brought in entirely or almost entirely from $C_{16}$ and $C_{18}$ in blend since little to no $C_{16}$ and $C_{18}$ is introduced except through the blend) is in the range of 0.7 to 1.4, preferably, 0.8 to 1.2, more preferably 0.9 to 1.1 and most preferably is about 1:1. Preferably the bar has a transmittance of at least 15%, more preferably at least 16%, more preferably at least 18%, more preferably at least 20%. The transmittance may range from 15% to 60%.

In a preferred bar, the ratio of C16 to C18 in the bar (introduced entirely or almost entirely from the fatty acid blend) is 0.9 to 1:1; level of polyol is 3 to 20%, preferably 7 to 13% by wt.; and transmittance is ≥16%.

A preferred bar has a ratio of $C_{16}$ to $C_{18}$ in the bar of 0.9 to 1:1; 0.5 to 10% sugar (e.g., sucrose) and 0.2 to 10% is hydroxy oleic acid.

Applicants have found that these formulations provide compositions having enhanced transparency relative to compositions where these criteria (i.e., where combination of $C_{16}$ to $C_{18}$ is at least 25% by wt. of bar and ratio of $C_{16}$ to $C_{18}$ is about 1:1) are not met. The art does not disclose that ratios of $C_{16}$ to $C_{18}$ are to be equalized. Indeed, there is no process disclosed in the art to calculate the ratios of $C_{16}$ to $C_{18}$ in the blends (and overall composition) or to add either one or the other to bring the ratio to within ratios described and claimed. There is no reason to teach these steps as there is no appreciation of the final benefit this provides in extruded bars where fatty acid blends used to prepare the bars are derived predominantly from vegetal oils.

The present invention is the result of experimentation investigating the use of different blends of fatty acids derived primarily from vegetal oils rather than animal based oils. Applicants unexpectedly found specific compositions where they could improve transparency while maintaining structuring and processing properties. More specifically, applicants found they could obtain extruded soap bars based predominantly on vegetal oils which have superior transparency, all while retaining such structuring properties.

DETAILED DESCRIPTION OF THE INVENTION

The personal washing bars of the invention are preferably extruded and preferably stamped bars suitable for mass market applications. One embodiment of the invention is a personal washing bar that includes:

a) from 55 to 80% by weight of soap, wherein said soap comprises fatty acid blend, derived predominantly from vegetable based oils, wherein said fatty acid blend comprises from 25% to 45% of a combined $C_{16}$ (palmitic acid) and $C_{18}$ (stearic acid) fatty acids, their salts or their mixtures thereof; by 25 to 45% is meant that of the 100% fatty acids making up the fatty acid blend (which blend of fatty acid comprise 55-80% by wt. of the total personal washing bar), 25-45% of the blend is combined $C_{16}$ to $C_{18}$. The fatty blend (including $C_{16}$ and $C_{18}$ fatty acid) may include some fatty acids derived from animal sources (such as tallow), but such fatty acids are present at 3% or less, preferably 2% or less, preferably 1% or less, or are most preferably absent as a percent of the overall bar composition. The fatty acid blend also includes unsaturated $C_{16}$ and $C_{18}$, but the unsaturated $C_{16}$ to $C_{18}$ are not included in the minimum amount of 25% or in the ratio of $C_{16}$ to $C_{18}$ of 1:1 because they are considered other types of fatty acids for the purpose of transparency.

b) the bar further comprises polyols in an amount ranging from 3 to 25%, preferably 3 to 20% by weight of the soap bar composition;

c) the bar composition comprises co-adjuvants selected from the group of polymers, organic and inorganic adjuvants, electrolytes, benefit agents and other minor ingredients in an amount ranging from 0.1 to 40%, preferably 10 to 25% by weight of the soap composition; and d) the remainder of the composition comprises water;

wherein the ratio by weight of $C_{16}$ (palmitic acid) fatty acids to $C_{18}$ (stearic acid) fatty acids (unsaturated) in the bar (introduced entirely or almost entirely from the blend) is from 0.7 to 1.4, preferably, 0.8 to 1.2, more preferably 0.9 to 1.1 and more preferably 1:1; and wherein the bar has a transmittance of at least 15%, preferably at least 16%, preferably at least 18%; the range may vary from 15 to 60%, preferably 16 to 50%.

In fatty acid blends derived from vegetal oils, typically there is much higher amount of $C_{16}$ than $C_{18}$ and/or the total amount of $C_{16}$ and $C_{18}$ (unsaturated $C_{16}$ and $C_{18}$ combined) in such blend is outside (typically below) the 25% minimum required by our invention. Certainly, there is no realization that maintaining minimum specific amounts and ratios of saturated $C_{16}$ and saturated $C_{18}$ provides enhanced transmittance.

Preferably the bars comprise glycerol, sorbitol or mixtures thereof. Preferably, the bars comprise 12-hydroxy oleic acid (independent of fatty acids making up the fatty acid blend). Preferably, they comprise both polyol which is glycerol, sorbitol or mixture, and 12-hydroxy oleic.

The invention further comprises a method of enhancing transparency in extruded soap bars, comprising:

a) selecting or balancing a fatty acid blend, wherein the fatty acid blend comprises at least $C_{16}$ (palmitic acid) and $C_{18}$ (stearic acid), their salts or their mixtures thereof (the initial ratio of $C_{16}$ to $C_{18}$ within the blend is know from supplier or can be readily calculated) to obtain a bar wherein the ratio of saturated $C_{16}$ to saturated Cis fatty acids or salts in the blend is 0.7 to 1.4, preferably 0.8 to 1.2, more preferably 0.9 to 1.1 and more preferably 1.1 b) adding co-adjuvants selected from the group of polyols, polymers, organic and inorganic adjuvants, electrolytes, benefit agents and other minor ingredients in an amount from 0.1 to 50% by weight, preferably 10 to 25% by wt. of the soap composition;

c) further adding the remainder as water (balances component (a), component (b) and component (c) can be mixed or added in any order).

The final soap bar composition comprises a balanced fatty acid blend with a ratio of $C_{16}$ fatty acid (palmitic acid) to $C_{18}$ fatty acid (stearic acid) in the blend (as well as in the bar) of from 0.7 to 1.4. In step (a) above, "balancing" means adding (or subtracting) sufficient $C_{16}$ and $C_{18}$ to obtain a minimum combined overall amount (25%-45% of the fatty acid blend) to fall within ratios (saturated $C_{16}$ to saturated $C_{18}$) of 0.7 to 1.4.

Soap Composition

The present invention relates to extruded personal washing bars that comprise a soap with minimum specific levels (25-45% of fatty acid blend) and ratios of specific fatty acids (ratio $C_{16}$ to $C_{18}$ of 0.7 to 1.4); optionally one or more added polyols, polymers, organic and inorganic adjuvant materials, electrolytes, benefit agents and other minor ingredients; and the remainder of water. These components of the bar composition that are used to manufacture and evaluate the bars are described below. The bar compositions of the invention are capable of being manufactured by processes that generally involve the extrusion forming of ingots or billets, and stamping or molding of these billets into individual tablets, cakes, or bars and alternatively the products can be obtained by the melt cast process.

Fatty Acids

Typical fatty acids distribution in oils and fats from different sources of fats and oils are shown in Chart 1:

CHART 1

| | Fats and Oils Composition | | | | | | | | | | |
|---|---|---|---|---|---|---|---|---|---|---|---|
| Fats and oils | Caprylic C8:0 | Capric C10:0 | Lauric C12:0 | Myristic C14:0 | Palmitic C16:0 | Stearic C18:0 | Oleic C18:1 | Linoleic C18:2 | Other | Ratio C16/C18 | Amount of C16 + C18 |
| Tallow | | | | 3.4 | 26.3 | 22.4 | 43.1 | 1.4 | 3.4 | 1.17 | 48.70 |
| Palm oil | | | 0.3 | 1.1 | 43.1 | 4.6 | 39.3 | 10.7 | 0.9 | 9.37 | 47.70 |
| Palm stearin | | | 0.7 | 1.5 | 55.7 | 4.8 | 29.5 | 7.2 | 0.6 | 11.60 | 60.50 |
| Coconut oil | 7.6 | 7.3 | 48.2 | 16.6 | 9 | 3.8 | 5 | 2.5 | | 2.37 | 12.80 |
| Palm kernel oil | 1.4 | 2.9 | 50.9 | 18.4 | 9.7 | 1.9 | 14.6 | 1.2 | | 5.11 | 11.60 |
| Palm kernel olein | 4.3 | 3.7 | 42.6 | 12.4 | 8.4 | 2.5 | 22.3 | 3.4 | 0.4 | 3.36 | 10.90 |

Source: *Soap Manufacturing Technology*, Editor: Luis Spitz, L. Spitz, Inc., AOCS Press

CHART 2

| Fatty Acid | Arachis | Babassu | Coconut | Cottonseed | Grapeseed | Maize | Mustard seed | Olive oil | Palm | Palm Kernel |
|---|---|---|---|---|---|---|---|---|---|---|
| C6 | Nd | nd | 0.0-0.6 | nd | nd | nd | 0.0-0.5 | nd | ns | 0.0-0.8 |
| C8 | Nd | 2.6-7.3 | 4.6-9.4 | nd | nd | nd | 0.0-0.5 | nd | ns | 2.4-6.2 |
| C10 | Nd | 1.2-7.6 | 5.5-7.8 | nd | nd | nd | 0.0-0.5 | nd | ns | 2.6-5.0 |
| C12 | 0.0-0.1 | 40.0-55.0 | 45.1-50.3 | 0.0-0.2 | 0.0-0.5 | 0.0-0.3 | 0.0-0.5 | nd | 0.0-0.4 | 41.0-55.0 |
| C14 | 0.0-0.1 | 11.0-27.0 | 16.8-20.6 | 0.6-1.0 | 0.0-0.3 | 0.0-0.3 | 0.0-1.0 | <0.05 | 0.5-2.0 | 14.0-18.0 |
| C16 | 8.3-14.0 | 5.2-11.0 | 7.7-10.2 | 21.4-26.4 | 5.5-11 | 8.6-16.5 | 0.5-4.5 | 7.5-20 | 40.1-47.5 | 6.5-10.0 |
| C16:1 | 0.0-0.2 | nd | Nd | 0.0-1.2 | 0.0-1.2 | 0.0-0.4 | 0.0-0.5 | 0.3-3.5 | 0.0-0.6 | ns |
| C17 | Nd | nd | Nd | nd | nd | nd | nd | nd | ns | ns |
| C17:1 | Nd | nd | Nd | nd | nd | nd | nd | nd | ns | ns |
| C18:0 | 1.9-4.4 | 1.8-7.4 | 2.3-3.5 | 2.1-3.3 | 3.0-6.0 | 1.0-3.3 | 0.5-2.0 | 0.5-5.0 | 3.5-6.0 | 1.3-3.0 |
| C18:1 | 36.4-67.1 | 9.0-20.0 | 5.4-8.1 | 14.7-21.7 | 12-28 | 20.0-42.2 | 8.0-23 | 55-83 | 36.0-44.0 | 12.0-19.0 |

CHART 2-continued

| Fatty Acid | Arachis | Babassu | Coconut | Cottonseed | Grapeseed | Maize | Mustard seed | Olive oil | Palm | Palm Kernel |
|---|---|---|---|---|---|---|---|---|---|---|
| C18:2 | 14.0-43.0 | 1.4-6.6 | 1.0-2.1 | 46.7-58.2 | 58-78 | 39.4-62.5 | 10-24 | 3.5-21 | 6.5-12.0 | 1.0-3.5 |
| C18:3 | 0.0-0.1 | nd | 0.0-0.2 | 0.0-0.4 | 0.0-1.0 | 0.5-1.5 | 6.0-18 | <1.5 | 0.0-0.5 | |
| C20:0 | 1.1-1.7 | nd | 0.0-0.2 | 0.2-0.5 | 0.0-1.0 | 0.3-0.6 | 0.0-1.5 | <0.8 | 0.0-1.0 | |
| C20:1 | 0.7-1.7 | nd | 0.0-0.2 | 0.0-0.1 | nd | 0.2-0.4 | 5.0-13 | tr | ns | 0.0-1.0 |
| C20:2 | Nd | nd | Nd | 0.0-0.1 | nd | 0.0-0.1 | 0.0-1.0 | nd | ns | 0.0-1.0 |
| C22:0 | 2.1-4.4 | nd | Nd | 0.0-0.6 | 0.0-0.3 | 0.0-0.5 | 0.2-2.5 | <0.2 | ns | 0.0-1.0 |
| C22:1 | 0.0-0.3 | nd | Nd | 0.0-0.3 | nd | 0.0-0.1 | 22-50 | nd | nd | 0.0-1.0 |
| C22:2 | Nd | nd | 0.0-0.1 | nd | nd | nd | 0.0-1.0 | nd | ns | 0.0-1.0 |
| C24:0 | 1.1-2.2 | nd | Nd | 0.0-0.1 | 0.0-0.1 | 0.0-0.4 | 0.0-0.5 | <1.0 | ns | 0.0-1.0 |
| C24:1 | 0.0-0.3 | nd | Nd | nd | nd | nd | 0.5-2.5 | nd | ns | 0.0-1.0 |

Source: *The Lipid Handbook, Second Edition*, Frank D. Gunstone et al. Electronic Publishing Division
nd—not determined
ns—not specified

CHART 3

| Fatty Acid | Palm Stearin | Rapeseed | Rapeseed (low erucic acid) | Safflower seed | Sesame seed | Soya bean | Sunflower seed |
|---|---|---|---|---|---|---|---|
| C6 | nd | 0.1 | nd | nd | nd | nd | nd |
| C8 | nd | 0.1 | nd | nd | nd | nd | nd |
| C10 | nd | 0.1 | nd | nd | nd | nd | nd |
| C12 | 0.1-0.4 | 0.1 | nd | nd | nd | 0.0-0.1 | 0.0-0.1 |
| C14 | 1.1-1.8 | 0.2 | 0.0-0.2 | 0.0-0.2 | 0.0-0.1 | 0.0-0.2 | 0.0-0.2 |
| C16 | 48.-73.8 | 1.5-6.0 | 3.3-6.0 | 5.3-8.0 | 7.9-10.2 | 8.0-13.3 | 5.6-7.6 |
| C16:1 | 0.05-0.2 | 0.0-3.0 | 0.1-0.6 | 0.0-0.2 | 0.1-0.2 | 0.0-0.2 | 0.0-0.3 |
| C17 | nd | nd | 0.0-0.3 | nd | 0.0-0.2 | nd | nd |
| C17:1 | nd | nd | 0.0-0.3 | nd | 0.0-0.1 | nd | nd |
| C18:0 | 3.9-5.6 | 0.5-3.1 | 1.1-2.5 | 1.9-2.9 | 4.8-6.1 | 2.4-5.4 | 2.7-6.5 |
| C18:1 | 15.6-36.0 | 8-60 | 52.0-66.9 | 8.4-21.3 | 35.9-42.3 | 17.7-26.1 | 14.0-39.4 |
| C18:2 | 3.2-9.8 | 11-23 | 16.1-24.8 | 67.8-83.2 | 41.5-47.9 | 49.8-57.1 | 48.3-74.0 |
| C18:3 | 0.1-0.6 | 5-13 | 6.4-14.1 | 0.0-0.1 | 0.3-0.4 | 5.5-9.5 | 0.0-0.2 |
| C20:0 | 0.3-0.6 | 0.0-3.0 | 0.2-0.8 | 0.2-0.4 | 0.3-0.6 | 0.1-0.6 | 0.2-0.4 |
| C20:1 | nd | 3-15 | 0.1-3.4 | 0.1-0.3 | 0.0-0.3 | 0.0-0.3 | 0.0-0.2 |
| C20:2 | nd | 0.0-1.0 | 0.0-1.0 | nd | nd | 0.0-0.1 | nd |
| C22:0 | nd | 0.0-2.0 | 0.0-0.5 | 0.2-0.8 | 0.0-0.3 | 0.3-0.7 | 0.5-1.3 |
| C22:1 | nd | 5-60 | 0.0-2.0 | 0.0-1.8 | nd | 0.0-0.3 | 0.0-0.2 |
| C22:2 | nd | 0.0-2.0 | 0.0-0.1 | nd | nd | nd | 0.0-0.3 |
| C24:0 | nd | 0.0-2.0 | 0.0-0.2 | 0.0-0.3 | 0.0-0.4 | 0.2-0.3 | |
| C24:1 | nd | 0.0-3.0 | 0.0-0.4 | 0.0-0.2 | nd | nd | nd |

Source: *The Lipid Handbook, Second Edition*, Frank D. Gunstone et al. Electronic Publishing Division
nd—not determined
ns—not specified From the Charts 1-3, we can find the range of ratios of $C_{16}/C_{18}$ by calculating the minimum ratio possible (by dividing the minimum amount of $C_{16}$ by the maximum amount of $C_{18}$) and, conversely, the maximum ratio (by dividing the maximum amount of $C_{16}$ by the minimum amount of $C_{18}$):

CHART 4

| | Ratio $C_{16}/C_{18}$ | | Amount of $C_{16}$ + $C_{18}$ as % | |
|---|---|---|---|---|
| Fatty Acid | Minimum | Maximum | Minimum | Maximum |
| *Arachis* | 1.89 | 7.37 | 10.20 | 18.40 |
| Babassu | 0.70 | 6.11 | 7.00 | 18.40 |
| Coconut | 2.20 | 4.43 | 10.00 | 13.70 |
| Cottonseed | 6.48 | 12.57 | 23.50 | 29.70 |
| Grapeseed | 0.92 | 3.67 | 8.50 | 17.00 |
| Maize | 2.61 | 16.50 | 9.60 | 19.80 |
| Mustard seed | 0.25 | 9.00 | 1.00 | 6.50 |
| Olive oil | 1.50 | 40.00 | 8.00 | 25.00 |
| Palm | 6.68 | 13.57 | 43.60 | 53.50 |
| Palm Kernel | 2.17 | 7.69 | 7.80 | 13.00 |
| Palm Stearin | 8.57 | 18.92 | 51.90 | 79.40 |
| Rapeseed | 0.48 | 12.00 | 2.00 | 9.10 |
| Safflower | 1.83 | 4.21 | 7.20 | 10.90 |

CHART 4-continued

| | Ratio $C_{16}/C_{18}$ | | Amount of $C_{16}$ + $C_{18}$ as % | |
|---|---|---|---|---|
| Fatty Acid | Minimum | Maximum | Minimum | Maximum |
| Sesame | 1.30 | 2.13 | 12.70 | 16.30 |
| Soya | 1.48 | 5.54 | 10.40 | 18.70 |
| Sunflower | 0.86 | 2.81 | 25.00 | 56.00 |

Source: The Lipid Handbook, Second Edition, Frank D. Gunstone et al. Electronic Publishing Division According to the The Lipid Handbook, the ratio of $C_{16}$ (palmitic acid) to $C_{18}$ (stearic acid) in tallow is around 1.17, with an amount of $C_{16}$+$C_{18}$ of 48.70% (see Chart 1, Row 1). It is noted that the ratios do not include unsaturated fatty acids such as oleic and linoleic. Tallow, with a ratio around 1 provides good transparency to soap bars in the art. This natural ratio makes tallow a good and well known source of fatty acids to produce transparent bars. Tallow of course is not a vegetal based oil. From the charts above, it can be seen that, for vegetal based fatty acid blends, either the ratio of $C_{16}$ and $C_{18}$ (saturated $C_{16}$ and saturated $C_{18}$) is outside 0.7-1.4 ratio, there is not a range of 25-45% combined $C_{16}$ and $C_{18}$ for such vegetal based blends, or both. For example,

*arachis*, coconut, cottonseed, maize, olive oil palm, palm kernel, palm stearin, safflower, sesame, and soya have a minimum ratio of $C_{16}$ (palmitic acid) to $C_{18}$ (stearic acid) higher than 1.4 due to their high levels of $C_{16}$ (palmitic acid), thus not yielding soap bars with desired transparency properties. In another specific example, palm oil (fatty acids derived from palm oil blend) have a ratio of $C_{16}$ to $C_{18}$ around 9.37, with amounts of $C_{16+018}$ of 47.70. This ratio again does not provide desired transparency, as it can be seen in Comparative 1 of Table 1.

Surprisingly, the inventors of the present invention found that, by using fatty acid blends with ratios of saturated $C_{16}$ to $C_{18}$ of 0.7 to 1.4, preferably 0.8 to 1.2, more preferably 0.9 to 1.1 and more preferably about 1; ensuring that total combined saturated $C_{16}$ and $C_{18}$ from the blend is 25% to 45% of blend; and minimizing fatty acids which are not derived from vegetal oils (3% or less, preferably 2% or less, more preferably 1% or less by wt. of entire composition); it is possible to produce transparent soap bars using vegetal oils, for example, palm oil. This is done by either lowering the amounts of saturated $C_{16}$ or raising amounts of saturated $C_{18}$, or both, to achieve ratios as noted. As previously indicated, as saturated $C_{16}$ and saturated $C_{18}$ introduced to bar composition is effectively introduced only from the blends used to form soap, ratios within the blend are effectively the same as ratios for entire bar composition. If for some reason, large amounts of saturated $C_{16}$ and/or $C_{18}$ are to be introduced at different point of the bar manufacturing, this can be taken into account when deciding on selection of blends or when balancing amounts of $C_{16}$ and $C_{18}$ in selected blends.

Vegetal oils (vegetal and vegetable are used interchangeably) are an important source of fatty acids for producing soap. In many parts of the world, soap is prepared with vegetal oils due to its lower price when compared to tallow (animal based oil); or due to religious beliefs. Tallow is a source for production of biodiesel in much the same way as oils from plants. Also, a significant use of tallow is for the production of shortening, thus competing in price with vegetal oils and having increased costs. In India, tallow is not used in making soap because the Hindu religion considers cows to be sacred beings, thus extracting tallow is not a practice in this big market for soap bars. Also, palm oil is considerably cheaper than tallow in that region of the world. Further, in China and Brazil palm oil is also cheaper than tallow and yields good quality soap bars. Oils from preferred vegetal sources include oils which are from Babassu, Coconut, Cottonseed, Palm, Palm Kernel, Soya, Palm Stearin, Sunflower and algae. Preferably, bars of this invention use less than 3% fatty acid which is derived from animal based source such as tallow; preferably, bars have 0 to less than 2% tallow as blend. Preferably, they use less than 1% tallow as blend. Preferably tallow is absent altogether.

Fatty Acid Soap Blend

The fatty acid soaps, other surfactants and in fact all the components of the bar should be suitable for routine contact with human skin and preferably yield bars that have good transparency.

The present invention relates to a soap bar composition with improved transparency which comprises a blend of fatty acid derived predominantly from vegetal oil (preferably fatty acids in blend derived from animal source comprise 1% by wt. of fatty acids in overall bar). The blend is used in an amount of 55% to 80% by wt. of the soap bar. More preferably, the fatty acid blend comprises a fatty acid blend in an amount of 60 to 80% by wt. of the soap bar and most preferably, the fatty acid blend comprises a fatty acid blend in an amount of 60 to 78% by wt. of the soap bar.

Bars of the invention comprise one or more surfactants although the primary surfactant is fatty acid soap which is based on the fatty acid blends used. The preferred type of surfactant is fatty acid soap. The term "soap" is used herein in its popular sense, i. e., the alkali metal or alkanol ammonium salts of aliphatic, alkanes. or alkene monocarboxylic acids. Sodium potassium, mono- di- and tri-ethanol ammonium cations or combinations thereof are the most suitable for purposes of this invention. In general, sodium soaps are used in the compositions of this invention, but up to about 15% of the soap may be potassium or triethanolamine soaps. The soaps useful herein are the well known alkali metal salts of natural or synthetic aliphatic (alkanoic or alkenoic) acids having about 8 to about 24 carbon atoms. They may be described as alkali metal carboxylates of saturated or unsaturated hydrocarbons having about 8 to about 24 carbon atoms (e.g., the fatty acid blend).

The fatty acid blend is made from fatty acids that may be different fatty acids, typically fatty acids containing fatty acid moieties with chain lengths of from $C_8$ to $C_{24}$. The fatty acid blend may also contain relatively pure amounts of one or more fatty acids. Suitable fatty acids include, but are not limited to, butyric, caproic, caprylic, capric, lauric, myristic, myristelaidic, pentadecanoic, palmitic acid, palmitoleic, margaric, heptadecenoic, stearic acid, oleic, linoeleic, linolenic, arachidic, gadoleic, behenic and lignoceric acids and their isomers. In preferred embodiments, the fatty acid blend has, at least, fatty acids with a fatty acids moiety chain length of 16 (palmitic acid) and 18 (stearic acid) carbon atoms. Preferably together, $C_{16}$ and $C_{18}$ comprise at least 25% of the blend, preferably 25 to 45%, more preferably 35 to 40%. The 25-45% $C_{16}$ and $C_{18}$, fatty acids in the blend refer to saturated $C_{16}$ and $C_{18}$ and not to unsaturated fatty acid such as oleic. In preferred embodiments, the fatty acid blend (as well as final bar) has substantially similar amounts of saturated $C_{16}$ (palmitic acid) and saturated $C_{18}$ (stearic acid) fatty acids (e.g., ratio of $C_{16}$ to $C_{18}$ as defined above).

It should be noted that one could pass the $C_{18:1}$ (Oleic acid) and $C_{18:2}$ (Linoleic acid), from the fatty acid blend, through a process of hydrogenation to convert it to $C_{18}$ (Stearic acid). If such conversion occurs, $C_{18:1}$ (Oleic acid) or $C_{18:2}$ (Linoleic acid) fatty acids would then be part of the 25-45% saturated $C_{16}$ and $C_{18}$ making up the blend, and which is used to determine the ratio of $C_{16}$ and $C_{18}$.

As noted, the fatty acid blend of the present invention comprises relatively about equal amounts of $C_{16}$ (palmitic acid) and $C_{18}$ (stearic acid), which, according to the invention, determines the good transparency properties of the resultant soap bar composition.

In a preferred embodiment, the fatty acid blend may have a ratio of $C_{16}$ (palmitic acid) to $C_{18}$ (stearic acid) ranging from 0.7 to 1.4. More preferred ratios range from 0.8 to 1.1, even more preferably 0.9 to 1.1 and more preferably 1:1.

Besides the 25-45% saturated $C_{16}$ and $C_{18}$, the rest of the blend (75-55%) is made of other fatty acids such as unsaturated $C_{16}$ and $C_{18}$ and other chain length fatty acids.

The fatty acids may be eventually in the form of free fatty acids, preferably in an amount not higher than 5% of the fatty acid soap blend (e.g., the rest is soap).

Both fatty acid blend defined, as well as the rest of the bar composition, should be substantially free (<3%, preferably less than 2%) of tallow or other fatty acids derived from animal source. Most preferably, the fatty acid blend has a combined 25% to 45% of $C_{16}$ (palmitic acid) and $C_{18}$ (stearic acid) fatty acids. It is especially preferred to use the fatty blend described in combination with 3 to 25% by wt. of bars polyols to provide benefits of the invention. It is noted, however, if amount and ratios of fatty acid in the blend are not right, polyol will not overcome this deficit. Preferably, the bar contains 55 to 80% by wt. total fatty acid, of which 25 to 45% of total fatty acids are saturated $C_{16}$ and $C_{18}$ (e.g., not including oleic acid which has not been hydrogenated); preferably, the bar compositions further comprise 3 to 25% polyol, more preferably 3 to 10% polyol.

Polyols and Adjuvants

Another organic adjuvant used in the bar compositions is a polyol or mixture of polyols. Polyol is a term used herein to designate a compound having multiple hydroxyl groups (at least two, preferably at least three) which is highly water soluble, preferably freely soluble in water.

Many types of polyols are available including: relatively low molecular weight short chain polyhydroxy compounds such as glycerol and propylene glycol; sugars such as sorbitol, manitol, sucrose and glucose; and polymeric synthetic polyols such as polyalkylene glycols, for example polyoxyethylene glycol (PEG) and polyoxypropylene glycol (PPG); and alkanolamine, for example trialkanolamine such as triethanolamine (TEA).

Especially preferred polyol are glycerol, sorbitol and their mixtures. Another polyol which may be used is trialkanolamine such as triethanolamine (TEA), this is both a triol and an amine.

The level of polyol is critical in forming a thermoplastic mass which material properties are suitable for both high speed manufacture (300-400 bars per minute) and for use as a personal washing bar. It has been found that when the polyol level is too low, the mass is not sufficiently plastic at the extrusion temperature (e.g. 40° C. to 45° C.) and the bars tend to exhibit higher mushing (swallowing due to water absorption) and rates of wear. Conversely, when the polyol level is too high, the mass becomes too soft to be formed into bars by high speed at normal process temperature. Preferred levels range from from 3 to 25% by weight of the soap composition, more preferred levels range from from 3 to 10%.

Sucrose is also a specially preferred polyol that enhances transparency. Accordingly, preferred levels of sucrose that deliver enhanced transparency range from 3 to 10%.

Another adjuvant which may be found in the bar composition is 12-hydroxy oleic acid (castor oil). As commonly known, castor oil is a vegetable oil obtained by pressing the seeds of the castor plant, *Ricinus communis*. Preferred levels of 12-hydroxy oleic acid (castor oil) range from 0.2% to 10%. The range may be considered to be within the 55-80% fatty acid blend (although it is not part of saturated $C_{16}$ and $C_{18}$ fatty acids which make up 25-45% of the blend), or may be considered as separate and outside the blend range. In either event, the overall amount is preferably 0.2 to 10% of total bar composition as noted.

Other adjuvants include trans-acids (i.e. elaidic acids). The preferred levels range from 3% to 10% of the total fatty acid blend. Trans-acids may be generated by the hydrogenation process of saturated fatty acids.

Preferably, the soap bar comprises 55% to 80% by weight fatty acids. No more than 3% by wt. of bar composition should be fatty acid derived from non-vegetal source. Fatty acids in the blend comprise at least a combined 25% of $C_{16}$ (palmitic acid) and $C_{18}$ (stearic acid) fatty acids, their salts or their mixtures thereof. Bars also comprise 3 to 25%, preferably 3 to 10% by weight of the soap bar composition polyols, preferably sugars, like sorbitol; 0.1 to 40% by weight of the soap composition may be co-adjuvants selected from the group of polymers, organic and inorganic adjuvants, electrolytes, benefit agents and other minor ingredients; and the remainder of water. The soap bar composition is substantially made from vegetal based oil having a ratio by weight of saturated $C_{16}$ (palmitic acid) to saturated $C_{18}$ (stearic acid) fatty acids substantially in the range from 0.7 to 1.4, preferably 0.8 to 1.1, preferably 0.9 to 1.1.

Optional Ingredients

Synthetic Surfactants

The bar compositions can optionally include non-soap synthetic type surfactants (detergents)—so called syndets. Syndets can include anionic surfactants, nonionic surfactants, amphoteric or zwitterionic surfactants and cationic surfactants.

The level of synthetic surfactant present in the bar is generally less than 25%, preferably less than 15%, preferably up to 10% and most preferably from 0 to 7% based on the total weight of the bar composition.

The anionic surfactant may be, for example, an aliphatic sulfonate, such as a primary alkane (e.g., $C_8$-$C_{22}$) sulfonate, primary alkane (e.g., $C_8$-$C_{22}$) disulfonate, $C_8$-$C_{22}$ alkene sulfonate, $C_8$-$C_{22}$ hydroxyalkane sulfonate or alkyl glyceryl ether sulfonate (AGS); or an aromatic sulfonate such as alkyl benzene sulfonate, Alpha olefin sulfonates are another suitable anionic surfactant.

The anionic may also be an alkyl sulfate (e.g. $C_{12}$-$C_{18}$ alkyl sulfate), especially a primary alcohol sulfate or an alkyl ether sulfate (including alkyl glyceryl ether sulfates).

The anionic surfactant can also be a sulfonated fatty acid such as alpha sulfonated tallow fatty acid, a sulfonated fatty acid ester such as alpha sulfonated methyl tallowate or mixtures thereof.

The anionic surfactant may also be alkyl sulfosuccinates (including mono- and dialkyl. e.g., $C_6$-$C_{22}$ sulfosuccinates); alkyl and acyl taurates, alkyl and acyl sarcosinates, sulfoacetates, $C_8$-$C_{22}$ alkyl phosphates and phosphates, alkyl phosphate esters and alkoxyl alkyl phosphate esters, acyl lactates or lactylates, $C_8$-$C_{22}$ monoalkyl succinates and maleates, sulphoacetates and acyl isethionates.

Another class of anionics is $C_8$ to $C_{20}$ alkyl ethoxy (1-20 EO) carboxylates.

Another suitable anionic surfactant is $C_8$-$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms. The acyl isethionate may also be alkoxylated isethionates Acyl isethionates, when present, will generally range from about 0.5% to about 25% by weight of the total composition.

In general, the anionic component will comprise the majority of the synthetic surfactants used in the bar composition.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. Suitable amphoteric surfactants include amphoacetates, alkyl and alkyl amido betaines, and alkyl and alkyl amido sulphobetaines.

Amphoacetates and diamphoacetates are also intended to be covered in possible zwitterionic and/or amphoteric compounds which may be used.

Suitable nonionic surfactants include the reaction products of compounds having a hydrophobic group and a reactive hydrogen atom. for example aliphatic alcohols or fatty acids, with alkylene oxides, especially ethylene oxide either alone or with propylene oxide. Examples include the condensation products of aliphatic ($C_8$-$C_{18}$) primary or secondary linear or branched alcohols with ethylene oxide and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as alkyl polysaccharides and alkyl polysaccharide amides.

Examples of cationic detergents are the quaternary ammonium compounds such as alkyldimethylammonium halides.

Finishing Adjuvant Materials

These are ingredients that improve the aesthetic qualities of the bar especially the visual, tactile and olefactory properties either directly (perfume) or indirectly (preservatives). A wide variety of optional ingredients can be incorporated in the bar composition of the invention. Examples of adjuvants include but are not limited to: perfumes; fatty alcohols, ethoxylated fatty acids, solid esters; dyes; pearlizing agent such coated micas and other interference pigments; plate like mirror particles such as organic glitters; sensates such as menthol and ginger; preservatives such as dimethyloldimethylhydantoin (Glydant XL1000), parabens, sorbic acid and the like; anti-oxidants such as, for example, butylated hydroxytoluene (BHT); chelating agents such as salts of ethylene diamine tetra acetic acid (EDTA) and trisodium etridronate; emulsion stabilizers; auxiliary thickeners; buffering agents; and mixtures thereof.

The level of pearlizing agent should be between about 0.1% to about 3%, preferably between 0.1% and 0.5% and most preferably between about 0.2 to about 0.4% based on the total weight of the bar composition.

Skin Benefit Agents

A particular class of optional ingredients highlighted here is skin benefit agents included to promote skin and hair health and condition. Potential benefit agents include but are not limited to: lipids such as cholesterol, ceramides, and pseudoceramides; antimicrobial agents such as TRICLOSAN; sunscreens such as cinnamates; other types of exfoliant particles such as polyethylene beads, walnut shells, apricot seeds, flower petals and seeds, and inorganics such as silica, and pumice; additional emollients (skin softening agents) such as long chain alcohols and waxes like lanolin; additional moisturizers; skin-toning agents; skin nutrients such as vitamins like Vitamin C, D and E and essential oils like bergamot, citrus unshiu, calamus, and the like; water soluble or insoluble extracts of avocado, grape, grape seed, myrrh, cucumber, watercress, calendula, elder flower, geranium, linden blossom, amaranth, seaweed, gingko, *ginseng*, carrot; *impatiens balsamina*, camu camu, *alpina* leaf and other plant extracts such as witch-hazel, and mixtures thereof.

The composition can also include a variety of other active ingredients that provide additional skin (including scalp) benefits. Examples include anti-acne agents such as salicylic and resorcinol; sulfur-containing D and L amino acids and their derivatives and salts, particularly their N-acetyl derivatives; anti-wrinkle, anti-skin atrophy and skin-repair actives such as vitamins (e.g., A, E and K), vitamin alkyl esters, minerals, magnesium, calcium, copper, zinc and other metallic components; retinoic acid and esters and derivatives such as retinal and retinol, vitamin B3 compounds, alpha hydroxy acids, beta hydroxy acids, e.g. salicylic acid and derivatives thereof; skin soothing agents such as aloe vera, jojoba oil, propionic and acetic acid derivatives, fenamic acid derivatives; artificial tanning agents such as dihydroxyacetone; tyrosine; tyrosine esters such as ethyl tyrosinate and glucose tyrosinate; skin lightening agents such as aloe extract and niacinamide, alpha-glyceryl-L-ascorbic acid, aminotyroxine, ammonium lactate, glycolic acid, hydroquinone, 4 hydroxyanisole, sebum stimulation agents such as bryonolic acid, dehydroepiandrosterone (DHEA) and orizano; sebum inhibitors such as aluminum hydroxy chloride, corticosteroids, dehydroacetic acid and its salts, dichlorophenyl imidazoldioxolan (available from Elubiol); anti-oxidant effects, protease inhibition; skin tightening agents such as terpolymers of vinylpyrrolidone, (meth)acrylic acid and a hydrophobic monomer comprised of long chain alkyl (meth) acrylates; anti-itch agents such as hydrocortisone, methdilizine and trimeprazine hair growth inhibition; 5-alpha reductase inhibitors; agents that enhance desquamation; anti-glycation agents; anti-dandruf agents such as zinc pyridinethione; hair growth promoters such as finasteride, minoxidil, vitamin D analogues and retinoic acid and mixtures thereof.

Electrolytes

The soap bars include 0.5 wt % to 5 wt % electrolyte. Preferred electrolytes include chlorides, sulphates and phosphates of alkali metals or alkaline earth metals. Without wishing to be bound by theory it is believed that electrolytes help to structure the solidified soap mass and also increase the viscosity of the molten mass by common ion effect. Comparative soap bars without any electrolyte were found to be softer. Sodium chloride and sodium Sulphate are the most preferred electrolyte, more preferably at 0.6 to 3.6 wt %, and most preferably at 1.0 to 3.6 wt %.

Polymers

The soap bars may include 0.1 to 5 wt % of a polymer selected from acrylates or cellulose ethers. Preferred acrylates include cross-linked acrylates, polyacrylic acids or sodium polyacrylates. Preferred cellulose ethers include carboxymethyl celluloses or hydroxyalkyl celluloses. A combination of these polymers may also be used, provided the total amount of polymers does not exceed 5 wt %.

Acrylates

Preferred bars include 0.1 to 5% acrylates. More preferred bars include 0.15 to 3% acrylates. Examples of acrylate polymers include polymers and copolymers of acrylic acid crosslinked with polyallylsucrose as described in U.S. Pat. No. 2,798,053 which is herein incorporated by reference. Other examples include polyacrylates, acrylate copolymers or alkali swellable emulsion acrylate copolymers (e.g., ACULYN® 33 Ex. Rohm and Haas; CARBOPOL® Aqua SF-1 Ex. Lubrizol Inc.), hydrophobically modified alkali swellable copolymers (e.g., ACULYN® 22, ACULYN® 28 and ACULYN® 38 ex. Rohm and Haas). Commercially available crosslinked homopolymers of acrylic acid include CARBOPOL® 934, 940, 941, 956, 980 and 996 carbomers available from Lubrizol Inc. Other commercially available crosslinked acrylic acid copolymers include the CARBOPOL® Ultrez grade series (Ultrez® 10, 20 and 21) and the ETD series (ETD 2020 and 2050) available from Lubrizol Inc.

CARBOPOL® Aqua SF-1 is a particularly preferred acrylate. This compound is a slightly cross-linked, alkali-swellable acrylate copolymer which has three structural units; one or more carboxylic acid monomers having 3 to 10 carbon atoms, one or more vinyl monomers and, one or more mono- or polyunsaturated monomers.

Cellulose Ethers

Preferred bars include 0.1 to 5% cellulose ethers. More preferred bars include 0.1 to 3% cellulose ethers. Preferred cellulose ethers are selected from alkyl celluloses, hydroxyalkyl celluloses and carboxyalkyl celluloses. More preferred bars include hydroxyalkyl celluloses or carboxyalkyl celluloses and particularly preferred bars include carboxyalkyl cellulose. Preferred hydroxyalkyl cellulose includes hydroxymethyl cellulose, hydroxyethyl cellulose, hydroxypropyl cellulose and ethyl hydroxyethyl cellulose. Preferred carboxyalkyl cellulose includes carboxymethyl cellulose. It is particularly preferred that the carboxymethyl cellulose is in form of sodium salt of carboxymethyl cellulose.

Wax and Polyalkyleneglycols

Preferred wax includes paraffin wax and microcrystalline wax. When polyalkyleneglycols are used, preferred bars may include 0.01 to 5 wt % Polyalkyleneglycols, more preferably 0.03 to 3 wt % and most preferably 0.5 to 1 wt %. Suitable examples include polyethyleneglycol and polypropyleneglycol. A preferred commercial product is POLYOX® sold by The Dow Chemical Company.

Transparency Test

Introduction and Principle

In optics, transparency is the property of a material to allow the light to pass through it. In this broad definition, light is regarded as having any wavelength of the electromagnetic spectrum. Nevertheless, for practical purposes regarding transparent soap bars, 'light' is restricted to the visible part of the electromagnetic radiation. Opposite to transparency is opacity. Opacity can arise by light absorption, light scattering or a combination of both.

In practical aspects, transparent materials can be seen through in such a way that clear images of objects are formed at its opposite side. Translucent materials, by the other hand, allow light to pass through them diffusely and hence images are formed with lower definition.

When a perpendicular beam of light strikes a specimen, a number of effects may result, depending on the nature of the material. In a homogeneous material with a smooth surface, some of the incident light will be reflected from surfaces, and some will pass through the specimen unaltered. In this case, the intensity of the transmitted light will be diminished by the inherent absorbance of the material, dyes or pigments. In a rough surface, the diffuse scattering will decrease an object's imaging quality. Particles inside the material or structures on its surface may act as scatters and blocks the passage of light. The more scatters and blockage are present, the greater the amount of scattered and obstructed light and the lower is the transparency.

The appearance of a transparent product is a function of gloss, colour and transparency. Essential criteria for transparency are total transmittance, haze and clarity.

Transmittance is the fraction of incident light at a specified wavelength that passes through a sample. The transmittance T of a sample is defined as:

$$T=I/I0$$

where I0 is the intensity of the incident light and I is the intensity of the light coming out of the sample. Transmittance is related to absorbance A as A=−log T [1].

Equipment, Transparency Test, Protocol and Procedure

The equipment used to measurements all the prototypes were haze-gard plus from BYK Gardner supplier.

The haze-gard plus quantifies the visual perception with objective measurement data. All essential criteria for transparency can be measured with one instrument: total transmittance, transmission haze and see-through quality.

There are some interference in the measurement of transparency in soap bars which should be removed or minimized in order to get accurate readings. For example, differences in reflection affect transparency measurements. So, textured surfaces may result in different readings, depending on how the beam of light will strikes this rough surface. Specimen surfaces must be as plane-parallel as possible; a wedge shape will deflect light, changing the final reading. When taking comparative readings the specimen thickness shall be recorded, since absorbance increase in direct proportion to the light path length.

Sample color may affect the transparency measurement as well. All the transparency instruments consider the human spectral response, so the reading must be coherent with the human perception (much more sensible to the green samples than to the red ones). So, it is expected that the green sample readings are higher than the red sample readings.

In order to obtain standardization of the samples, the specimen thickness was fixed on 2.5 mm once the transmittance result is affected by thickness of the samples.

Using the transparency test described above, bars of the invention (i.e., meeting compositional transmittance test limitations) have transmittance of >15%, preferably ≥16%, preferably ≥18, more preferably ≥20%, more preferably ≥25%. A preferred range is ≥16% up to 60%.

EXAMPLES

Solid personal wash bars were prepared with different percentages of fatty acids in accordance with the formulations herein below.

TABLE 1

Comparative Examples

| Ingredients | Formulation code: Comparative 1 palm oil/palm oil stearin/palm kernel oil* % | Comparative 2 $C_{16}$:$C_{18}$ 1:10 ratio ** % |
|---|---|---|
| Na soap 80/20 | 69.81 | 69.81 |
| Sorbitol | 2.20 | 4.00 |
| Glycerine | 7.80 | 6.00 |
| Triethanolamine | 1.50 | 1.50 |
| Propylene glycol | 1.50 | 1.50 |
| Sugar | — | — |
| Water | 13.5 | 13.5 |
| Sodium Chloride | 1.20 | 1.20 |
| PKO Fatty acid | 1.25 | 1.25 |
| EDTA | 0.04 | 0.04 |
| EHDP | 0.02 | 0.02 |
| Fragrance Brahmana | 1.18 | 1.18 |
| Transmittance (%) | 0-5 | 5-10 |

*PO = palm oil
POS = palm oil stearin
PKO = palm kernel oil
** ratio is based on carbon chain distribution of fatty acids in final bar composition; most or all saturated $C_{16}$ and $C_{18}$ is introduced through blend

| | (*) Fat Charge Non-lauric/Lauric % | % |
|---|---|---|
| Palm Kernel Oil | 20.00 | 20.00 |
| Palm Oil | 5.50 | — |
| Palm Oil Stearine | | — |
| $C_{18}$ (Stearic acid) Acid | — | — |
| $C_{16}$ (Palmitic acid) Acid | — | 40.00 |
| Oleic Acid | — | 37.00 |

TABLE 1-continued

| Comparative Examples | | |
|---|---|---|
| Castor Oil (12-hydroxy oleic acid) | — | 3.00 |
| $C_{16}$:$C_{18}$ ratio | 9:1 ** | 1:10 ** |
| Iodine Value ($cgl_2/g$) | 39-41 | 39-41 |

** ratios for blends calculated based on distribution of fatty acids in the blend.

From Table 1 it can be seen that, relative to control where $C_{16}$ and $C_{18}$ ratio is 9:1, adjusting or using ratio of 1:10 makes little difference in transmittance.

TABLE 2

| Examples | | | |
|---|---|---|---|
| | Formulation code | | |
| Ingredients | Example 1 $C_{16}$:$C_{18}$ 0.73:1 ratio % | Example 2 $C_{16}$:$C_{18}$ 1:1 ratio % | Example 3 $C_{16}$:$C_{18}$ 1:1.35 ratio % |
| Na soap 80/20 | 69.81 | 69.81 | 69.81 |
| Sorbitol (as 100%) | 4.00 | 4.00 | 4.00 |
| Glycerine | 6.00 | 6.00 | 6.00 |
| Triethanolamine | 1.50 | 1.50 | 1.50 |
| Propylene glycol | 1.50 | 1.50 | 1.50 |
| Sugar | — | — | — |
| Water | 13.5 | 13.5 | 13.5 |
| Sodium Chloride | 1.20 | 1.20 | 1.20 |
| PKO Fatty acid | 1.25 | 1.25 | 1.25 |
| EDTA | 0.04 | 0.04 | 0.04 |
| EHDP | 0.02 | 0.02 | 0.02 |
| Fragrance Brahmana | 1.18 | 1.18 | 1.18 |
| Transmittance (%) | 16-21 | 18-23 | 20-25 |
| | (*) Fat Charge Non-lauric/Lauric | | |
| | % | % | % |
| Palm Kernel Oil | 20.00 | 20.00 | 20.00 |
| Palm Oil | 45.00 | 50.00 | 63.00 |
| Palm Oil Stearine | — | 10.00 | — |
| $C_{18}$ (Stearic acid) Acid | 25.00 | 20.00 | — |
| $C_{16}$ (Palmitic acid) Acid | — | — | 17.00 |
| Oleic Acid | 10.00 | — | — |
| Castor Oil (12-hydroxy oleic acid) | — | — | — |
| $C_{16}$:$C_{18}$ ratio | 0.73:1 | 1:1 | 1:1.35 |
| Iodine Value ($cgl_2/g$) | 39-41 | 39-41 | 39-41 |

Ratios calculated as noted in Table 1.

Table 2 shows that maintaining ratio between about 0.7 to 1.4 continues much higher transmittance.

TABLE 3

| Examples | | | |
|---|---|---|---|
| | Formulation code | | |
| Ingredients | Example 4 $C_{16}$:$C_{18}$ - 1:1 ratio + 3% Castor Oil % | Example 5 $C_{16}$:$C_{18}$ - 1:1 ratio + 5% Sugar % | Example 6 $C_{16}$:$C_{18}$ - 1:1 ratio 3% Castor Oil + 5% Sugar % |
| Na soap 80/20 | 69.81 | 64.81 | 64.81 |
| Sorbitol (as 100%) | 4.00 | 4.20 | 4.00 |
| Glycerine | 6.00 | 5.80 | 6.00 |
| Triethanolamine | 1.50 | 1.50 | 1.50 |
| Propylene glycol | 1.50 | 1.50 | 1.50 |

TABLE 3-continued

| Examples | | | |
|---|---|---|---|
| Sugar | — | 5.00 | 5.00 |
| Water | 13.5 | 13.5 | 13.5 |
| Sodium Chloride | 1.20 | 1.20 | 1.20 |
| PKO Fatty acid | 1.25 | 1.25 | 1.25 |
| EDTA | 0.04 | 0.04 | 0.04 |
| EHDP | 0.02 | 0.02 | 0.02 |
| Fragrance Brahmana | 1.18 | 1.18 | 1.18 |
| Transmittance (%) | 22-27 | 29-34 | 32-37 |
| | (*) Fat Charge Non-lauric/Lauric | | |
| | % | % | % |
| Palm Kernel Oil | 20.00 | 20.00 | 20.00 |
| Palm Oil | 45.00 | 50.00 | 45.00 |
| Palm Oil Stearine | 11.00 | 10.00 | 11.00 |
| $C_{18}$ (Stearic acid) Acid | 20.00 | 20.00 | 20.00 |
| $C_{16}$ (Palmitic acid) Acid | — | — | — |
| Oleic Acid | — | — | — |
| Castor Oil (12-hydroxy oleic acid) | 3.00 | — | 3.00 |
| $C_{16}$:$C_{18}$ ratio | 1:1 | 1:1 | 9:1 |
| Iodine Value ($cgl_2/g$) | 39-41 | 39-41 | 39-41 |

Ratios calculated as noted in Table 1.

Table 3 shows additional examples.

The results illustrate that balancing the amounts of (palmitic acid) and $C_{18}$ (stearic acid) fatty acids increased the transparency of the soap bar when compared to the soap bar without the balanced amounts. As should be appreciated, the transparent bar, in accordance with the various embodiments of the present invention, demonstrates transparent properties while comprising a soap with a fatty acid blend having from 25% to 45% of $C_{16}$ (palmitic acid) and $C_{18}$ (stearic acid) fatty acids, polyols, co-adjuvants, sucrose, 12-hydroxy oleic acid and having a ratio by weight of the fatty acids $C_{16}$ (palmitic acid) to $C_{18}$ (stearic acid) which is substantially 1, thus obtaining a transmittance of at least 16%.

The invention claimed is:

1. A transparent, extruded soap bar composition comprising:

a) from 55 to 80% by weight of soap bar composition of a fatty acid blend, wherein said fatty acid blend, comprises from 25% to 45% of said blend of saturated $C_{16}$ (palmitic acid) and saturated $C_{18}$ (stearic acid) fatty acids, their salts or their mixtures thereof, and wherein said fatty acid blend is a fatty acid blend derived from vegetal oil source and fewer than 3% of total fatty acids in the bar final composition is derived from animal source;

b) polyols in an amount ranging from 3 to 25% by weight of the soap bar composition;

c) co-adjuvants selected from the group of polymers, organic and inorganic adjuvants, electrolytes, benefit agents and other minor ingredients in an amount ranging from 0.1 to 40% by weight of the soap composition; and d) the remainder of water;

wherein the ratio by weight of the saturated $C_{16}$ (palmitic acid) to saturated $C_{18}$ (stearic acid) in the blend (and in final bar) is 0.7 to 1.4; and wherein transparency is defined by having a transmittance of at least 15% as measured by the transparency test described herein.

2. A transparent soap bar composition according to claim 1 wherein the soap bar composition comprises a ratio by weight of the fatty acids $C_{16}$ (palmitic acid) to $C_{18}$ (stearic acid) in the blend (and in final bar) is in the range from 0.8 to 1.2.

3. A transparent soap bar composition according to claim 2 wherein the soap bar composition comprises a ratio by weight of the fatty acids $C_{16}$ (palmitic acid) to $C_{18}$ (stearic acid) in the blend (and in bar) of about 1.

4. A transparent soap bar composition according to claim 1 wherein the polyol is selected from the group consisting of short chain polyhydroxy compounds, sugars, polymeric synthetic polyols; and alkanolamine.

5. A transparent soap bar composition according to claim 1 wherein the polyol ranges from 5% to 20% by weight of said soap composition.

6. A transparent soap bar composition according to claim 1 wherein said polyol comprises 3% to 10% by weight of sucrose, based on the weight of the soap bar composition.

7. A transparent soap bar composition according to claim 1 wherein the fatty acid blend comprises from 60% to 80% by weight of said soap composition, more preferably, the fatty acid blend comprises a fatty acid blend in an amount of 60 to 78% by wt. of the soap bar.

8. A transparent soap bar composition according to claim 1, comprising from 0.1 to 5% by weight of fatty acids in fatty acid blend which are in free fatty acid form.

9. A transparent soap bar composition according to claim 1 wherein the soap bar composition further comprises 0.2 to 10% of 12-hydroxy oleic acid.

10. A transparent soap bar composition according to claim 1 wherein fatty acid blend comprises 3 to 10% by weight of trans acids soaps, preferably elaidic acid.

11. A transparent bar composition according to claim 1 wherein the extruded soap bar composition has a transmittance of at least 16%, preferably of at least 20%, more preferably of at least 32%, according to the transparency test.

12. A bar according to claim 1 which is an extruded bar and wherein said bar can be extruded at a rate in excess of 9 kilograms per minute.

13. A transparent extruded soap bar composition according to claim 1, comprising:

a) from 55% to 80% by weight of soap bar composition fatty acid blend, wherein said fatty acid blend comprises from 25% to 45% of said blend of saturated $C_{16}$ (palmitic acid) and saturated $C_{18}$ (stearic acid) fatty acids, their salts or their mixtures thereof wherein said fatty acid blend is a fatty acid blend derived from vegetal source and substantially no fatty acids are derived from animal source;

b) polyols in an amount ranging from 3 to 25% by weight of the soap bar composition;

c) co-adjuvants selected from the group of polymers, organic and inorganic adjuvants, electrolytes, benefit agents and other minor ingredients in an amount ranging from 0.1 to 40% by weight of the soap composition;

d) the remainder of water;

wherein the ratio by weight of saturated $C_{16}$ (palmitic acid) to saturated $C_{18}$(stearic acid) is 0.7 to 1.4, wherein said transparency is defined by having a transmittance of at least 16%.

14. A transparent soap bar composition according to claim 1 comprising:

a) from 55% to 80% by weight of soap bar composition fatty acid blend, wherein fatty acid blend comprises from 25% to 45% of said blend of saturated $C_{16}$ (palmitic acid) and saturated $C_{18}$ (stearic acid) fatty acids, their salts or their mixtures thereof;

b) polyols other than sucrose in an amount ranging from 0 to 10% by weight of the soap bar composition;

c) co-adjuvants selected from the group of polymers, organic and inorganic adjuvants, electrolytes, benefit agents and other minor ingredients in an amount ranging from 0.1 to 40% by weight of the soap composition;

d) 3% to 10% by weight of sucrose;

e) 0.2 to 10% of 12-hydroxy oleic acid;

f) the remainder of water;

wherein the ratio by weight of the saturated $C_{16}$ (palmitic acid) to saturated $C_{18}$(stearic acid) is about 1, where said transparency is defined by having a transmittance of at least 32%.

15. A method of enhancing transparency soap bars comprising:

a) balancing a fatty acid blend, wherein the fatty acid blend comprises at least $C_{16}$ (palmitic acid) and $C_{18}$ (stearic acid), their salts or their mixtures thereof;

b) adding co-adjuvants selected from the group of polyols, polymers, organic and inorganic adjuvants, electrolytes, benefit agents and other minor ingredients in an amount from 0.1 to 40% by weight of the soap composition;

c) adding remainder of water, wherein the soap bar composition comprises a balanced fatty acid blend with a ratio by weight of saturated $C_{16}$ (palmitic acid) to saturated $C_{18}$ (stearic acid) in the blend (and in final bar) acid having a ratio in the range from 0.7 to 1.4.

* * * * *